US008116489B2

(12) United States Patent
Mejia et al.

(10) Patent No.: US 8,116,489 B2
(45) Date of Patent: Feb. 14, 2012

(54) ACCOUSTICALLY TRANSPARENT OCCLUSION REDUCTION SYSTEM AND METHOD

(75) Inventors: Jorge Patricio Mejia, Chatswood (AU); Harvey Albert Dillon, Turramurra (AU); Michael John Amiel Fisher, Cremorne (AU)

(73) Assignee: Hearworks Pty Ltd, East Melbourne, Victoria (AU)

( * ) Notice: Subject to any disclaimer, the term of this patent is extended or adjusted under 35 U.S.C. 154(b) by 986 days.

(21) Appl. No.: 11/576,175

(22) PCT Filed: Sep. 30, 2005

(86) PCT No.: PCT/AU2005/001506

§ 371 (c)(1),
(2), (4) Date: Aug. 15, 2007

(87) PCT Pub. No.: WO2006/037156

PCT Pub. Date: Apr. 13, 2006

(65) Prior Publication Data

US 2008/0063228 A1 Mar. 13, 2008

(30) Foreign Application Priority Data

Oct. 1, 2004 (AU) ..... 2004905703

(51) Int. Cl.
*H04R 25/00* (2006.01)
*H04R 3/00* (2006.01)

(52) U.S. Cl. ..... 381/318; 381/95

(58) Field of Classification Search ..... 381/95, 381/317, 318, 312, 320, 321, 71.6
See application file for complete search history.

(56) References Cited

U.S. PATENT DOCUMENTS

| | | | | |
|---|---|---|---|---|
| 2,983,790 | A | 5/1961 | Olson | |
| 4,494,074 | A | 1/1985 | Bose | |
| 4,985,925 | A | 1/1991 | Langberg et al. | |
| 5,195,139 | A | 3/1993 | Gauthier | |
| 5,267,321 | A | 11/1993 | Langberg | |
| 5,740,258 | A * | 4/1998 | Goodwin-Johansson | 381/72 |
| 5,774,565 | A | 6/1998 | Benning et al. | |
| 6,658,122 | B1 * | 12/2003 | Westermann et al. | 381/312 |
| 6,687,377 | B2 | 2/2004 | Voix et al. | |
| 6,766,031 | B1 | 7/2004 | Westermann | |
| 2003/0012391 | A1 | 1/2003 | Armstrong et al. | |

FOREIGN PATENT DOCUMENTS

| | | |
|---|---|---|
| CA | 2 381 516 | 10/2002 |
| WO | 00/28783 A1 | 5/2000 |
| WO | WO 02/085063 | 10/2002 |

* cited by examiner

*Primary Examiner* — Hai Phan
(74) *Attorney, Agent, or Firm* — Ladas & Parry LLP

(57) ABSTRACT

A system and method that reduces the perceptual effect resulting from ear occlusion include an electro-acoustic feedback network that produces phase canceling sounds in the ear, where a receiver and a microphone are located. A control mechanism controls the response of the feedback network to minimize distortion in the ear while maintaining a desired frequency response for external signals. Devices producing the external signal include hearing aids, personal sound devices, in ear monitors, communications headsets and hearing protectors. The integration of the above with these devices improves a user's perception of their own voice.

21 Claims, 17 Drawing Sheets

ACCOUSTICALLY TRANSPARENT OCCLUSION REDUCTION SYSTEM AND METHOD

FIELD OF THE INVENTION

The present invention relates to an improved occlusion reduction system for applications such as hearing aids, personal sound devices, in ear monitors, communications headsets and hearing protection devices.

DESCRIPTION OF BACKGROUND ART

An electro-acoustic negative feedback scheme was originally presented by H. F Olson, in 1961 in U.S. Pat. No. 2,983,790. A more comprehensive implementation was later proposed by Bose et al, in 1982 in U.S. Pat. No. 4,494,074 under the title "Feedback Control". Using headphones, Bose proposed the idea of an electro-acoustic feedback in the proximity of the ear canal. The concept was later used by Langberg et al, in 1988 in U.S. Pat. No. 4,985,925, describing a system functioning as a bilateral transducer drive with a shunt feedback correction network. Later on in 1991, Langberg et al, in U.S. Pat. No. 5,267,321 entitled "Active Sound Absorption" describes an electro-acoustical feedback system, with the receiver acting as both a diaphragm actuator and motion sensor. In 1996, U.S. Pat. No. 5,774,565 to Benning et al describes an electro-acoustic feedback subsystem with oscillation prevention circuit in the forward path of the loop. In 2002, U.S Patent Application No. 2003/0012391 A1 to Armstrong et al, entitled "Digital Hearing Aids System" discloses a hearing aid including an occlusion processing subsystem.

The occlusion effect is commonly described as a hollow or echoing like sound of a person's own voice. The occlusion effect results from acoustically sealing or partially sealing the ear, or to a greater effect sealing or partially sealing the ear canal from the external acoustic environment. As a result, the occlusion effect creates discomfort and/or an unnatural sound sensation. This problem is commonly reported to clinicians in the hearing aid industry as it affects a large number of hearing aid wearers (those with mild low-frequency hearing loss). Until now, there were at least two common schemes to decrease the occlusion effect in hearing aids, either using a vent or by increasing the insertion depth of the earmold into the ear canal. To restore naturalness of a hearing aid wearer's voice, vents of up to 3.5 mm in diameter may be employed. These vents need to be sufficiently large so that the residual sound pressure in the canal due to the occlusion effect is not significant. On the other hand, a sufficiently large vent limits the hearing aid amplification due to oscillations created by positive feedback occurring around the loop defined by an external microphone, amplifier, receiver, and path through the vent back to the external microphone.

The soft tissue in the ear canal is excited by vibration energy propagated by the skull and jaw due to the wearer's voice and this results in an increased sound pressure within the occluded of partially occluded ear relative to an open ear. Another solution is to insert the earmold further into the ear canal to fill the cartilaginous portion of the canal and hence reduce the occlusion effect at its source. However there are a number of practical problems relating to the deep insertion of an earmold, for instance physical discomfort.

While some of the aforementioned patents include methods to alter the response of the electro-acoustic feedback system, none of these patents incorporate methods to compensate for the effect that response alteration within the feedback system has on external signals such as from an external microphone or hearing aid processor. In addition, the aforementioned patents do not provide a mechanism to prevent the receiver from overloading by sensing the level of signal at the optimum point, being the input to the receiver.

SUMMARY OF THE INVENTION

It is an object of the present invention to provide an improved occlusion reduction system for applications such as hearing aids, personal sound devices, in ear monitors, communications headsets and hearing protection devices.

In accordance with a first aspect of the present invention, there is provided an electro-acoustic system comprising of: an electro-acoustic circuit including a negative-feedback loop comprising of: a microphone for generating an internal signal from an acoustical signal located within or closely coupled to an occluded or partially occluded ear; a second electronic circuit, (B) for modifying the internal signal to produce a processed internal signal; a combiner for combining the processed internal signal with a processed external signal to produce a combined signal; a first electronic circuit (A), for modifying the combined signal to produce an receiver signal; and a receiver for generating an acoustical signal from the receiver signal at a location within or closely coupled to the occluded or partially occluded ear; a third electronic circuit (C) for modifying an external signal such as from an external microphone or hearing aid processor to produce an external processed signal; a fourth electronic circuit (D), for estimating the level of the receiver signal optimally from the receiver signal and producing a control signal; wherein the processing performed by the second electronic circuit (B) preferably is controlled by the control signal.

The negative-feedback loop preferably can include a filter that alters the open loop response so that the real component of the response is large and negative at frequencies where the occlusion effect can be typically the greatest. Consequently reducing all signals introduced into the closed loop within this frequency range.

The third electronic circuit (C) preferably can include filtering that provides compensation for the closed loop response of the negative-feedback loop.

Optionally the filtering provided by the third electronic circuit (C) adapts to compensate for changes in the closed response of the negative-feedback loop.

Optionally the control signal can control the response of the first electronic circuit (A) while controlling the response of the third electronic circuit (C).

The microphone for generating the internal signal optionally can be coupled to the occluded or partially occluded ear by a tube. The receiver optionally can be coupled to the occluded or partially occluded ear by a tube. The microphone and receiver optionally can be combined in a single unit or jointly coupled to the occluded or partially occluded ear by a common tube. At least one of the electronic circuits can be implemented digitally. At least one of the digital electronic circuits can performed signal processing at a sampling rate at least four times that of the bandwidth of the signal.

In accordance with a further aspect of the present invention, there is provided an electro-acoustic system including a negative-feedback loop comprising of: a microphone for generating an internal signal from an acoustical signal located within or closely coupled to an occluded or partially occluded ear; a second electronic circuit (B) for modifying the internal signal to produce a processed internal signal; a combiner for combining the processed internal signal with a processed external signal to produce a combined signal; a first electronic circuit (A) for modifying the combined signal to produce a receiver signal; and a receiver for generating an acoustical signal from the receiver signal at a location within or closely coupled to the occluded or partially occluded ear; a third electronic circuit (C) for modifying an external signal such as from external microphone to produce a processed external signal; a fourth electronic circuit (D) for estimating the level of the receiver signal and producing a control signal from this estimate; wherein the control signal controls the processing performed by the second electronic circuit (B) and controls the processing performed by the third electronic circuit (C).

In accordance with a further aspect of the present invention, there is provided an electro-acoustic system including a negative-feedback loop comprising of: a microphone for generating an internal signal from an acoustical signal located within or closely coupled to an occluded or partially occluded ear; a second electronic circuit (B) for modifying the internal signal to produce a processed internal signal; a combiner for combining the processed internal signal with a processed external signal to produce a combined signal; a first electronic circuit (A) for modifying the combined signal to produce a receiver signal; and a receiver for generating an acoustical signal from the receiver signal at a location within or closely coupled to the occluded or partially occluded ear; a third electronic circuit (C) for modifying an external signal to produce a processed external signal; a fourth electronic circuit (D) for estimating the level of the receiver signal and producing a control signal from this estimate; wherein the control signal controls the processing performed by first electronic circuit (A) and controls the processing performed by the third electronic circuit (C).

In accordance with a further aspect of the present invention, there is provided a method of providing a negative feedback loop for an electro-acoustic system, the method including the steps of: (a) generating an internal signal representing an acoustical signal located within or closely coupled to an occluded or partially occluded ear; (b) modifying the internal signal to produce a processed internal signal; (c) combining the processed internal signal with a processed external signal to produce a combined signal; (d) modifying the combined signal to produce a receiver signal; (e) generating an acoustical signal from the receiver signal at a location within or closely coupled to the occluded or partially occluded ear; (f) modifying an external signal to produce a processed external signal; (g) estimating the level of the receiver signal either directly from the receiver signal or from the combined signal and producing a control signal from this estimate; wherein the degree of modification in step (b) is controlled by the control signal. The control signal can be utilised to control the amount of modification occurring in step (f).

In any of the aforementioned aspects of the present invention the fourth electronic circuit (D) optionally produces a control signal using estimates of the signal levels from the internal signal or the processed internal signal and the receiver signal or the combined signal.

BRIEF DESCRIPTION OF THE DRAWINGS

Preferred embodiments of the present invention will now be described with reference to the accompanying drawings in which.

DETAIL DESCRIPTION OF THE PREFERRED AND OTHER EMBODIMENTS

Figure 1A:
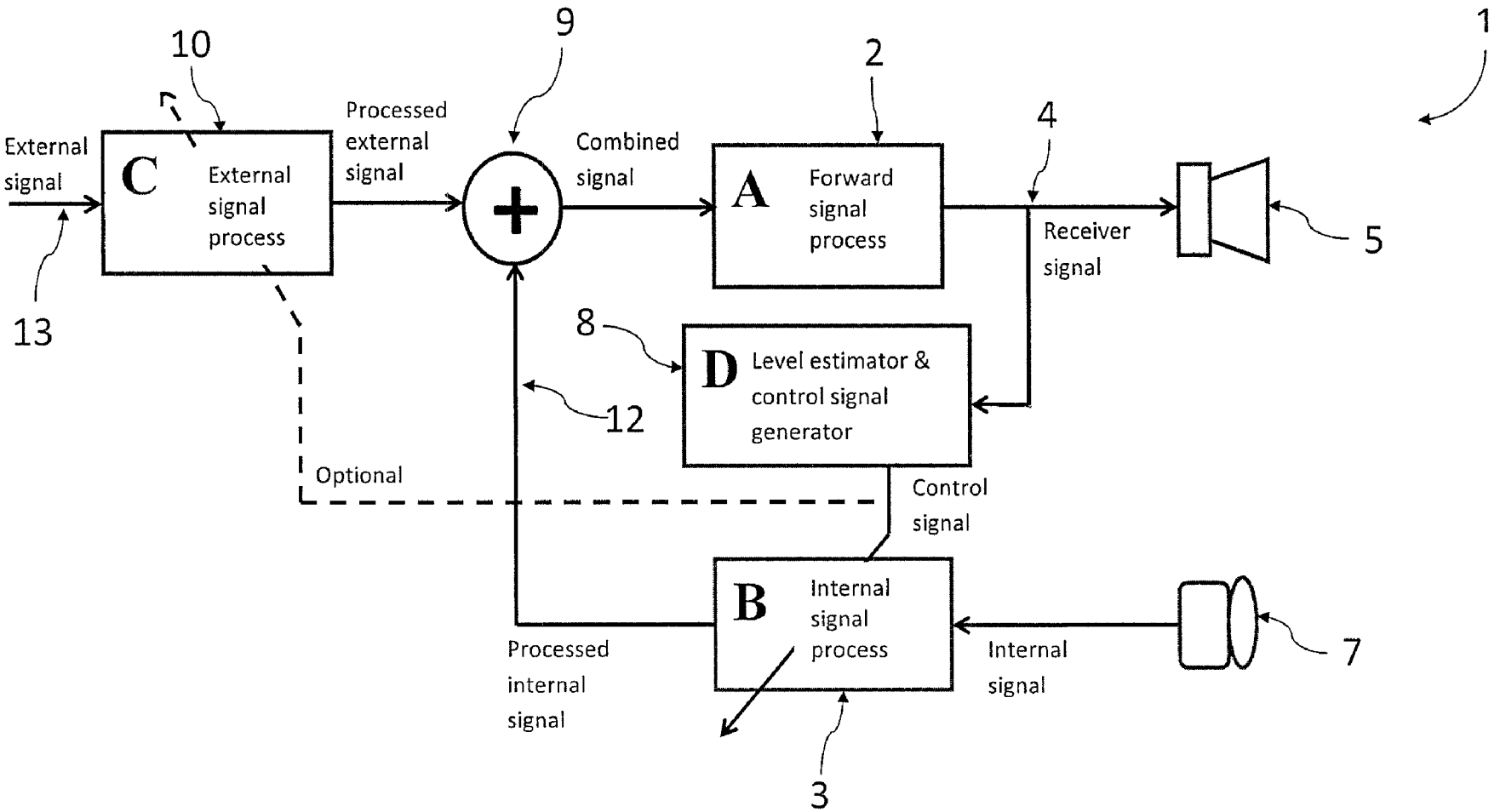
FIGS. 1*a-g* are block diagrams of the occlusion reduction scheme of the preferred embodiment.
Figure 1B:
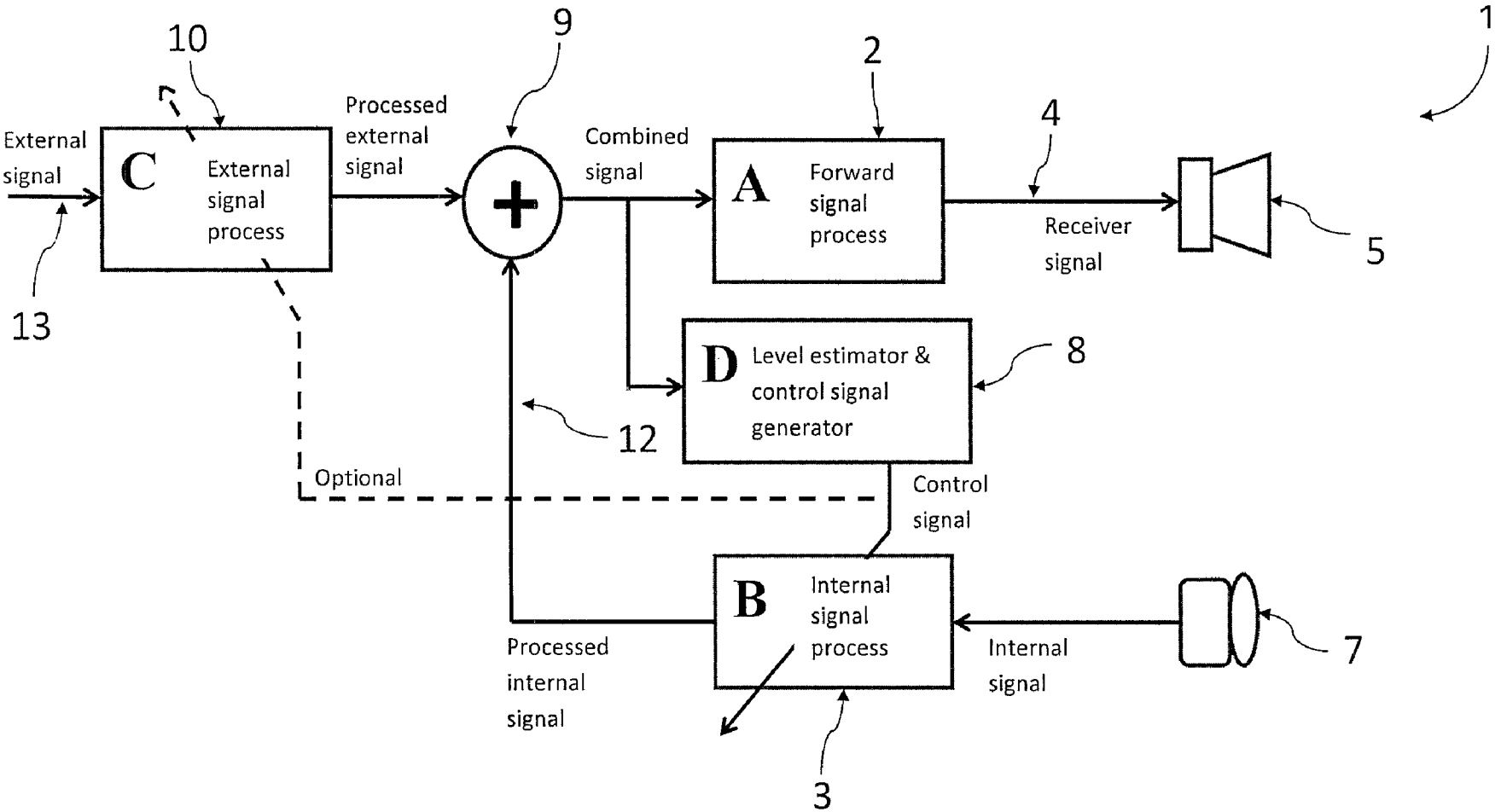
Figure 1C:
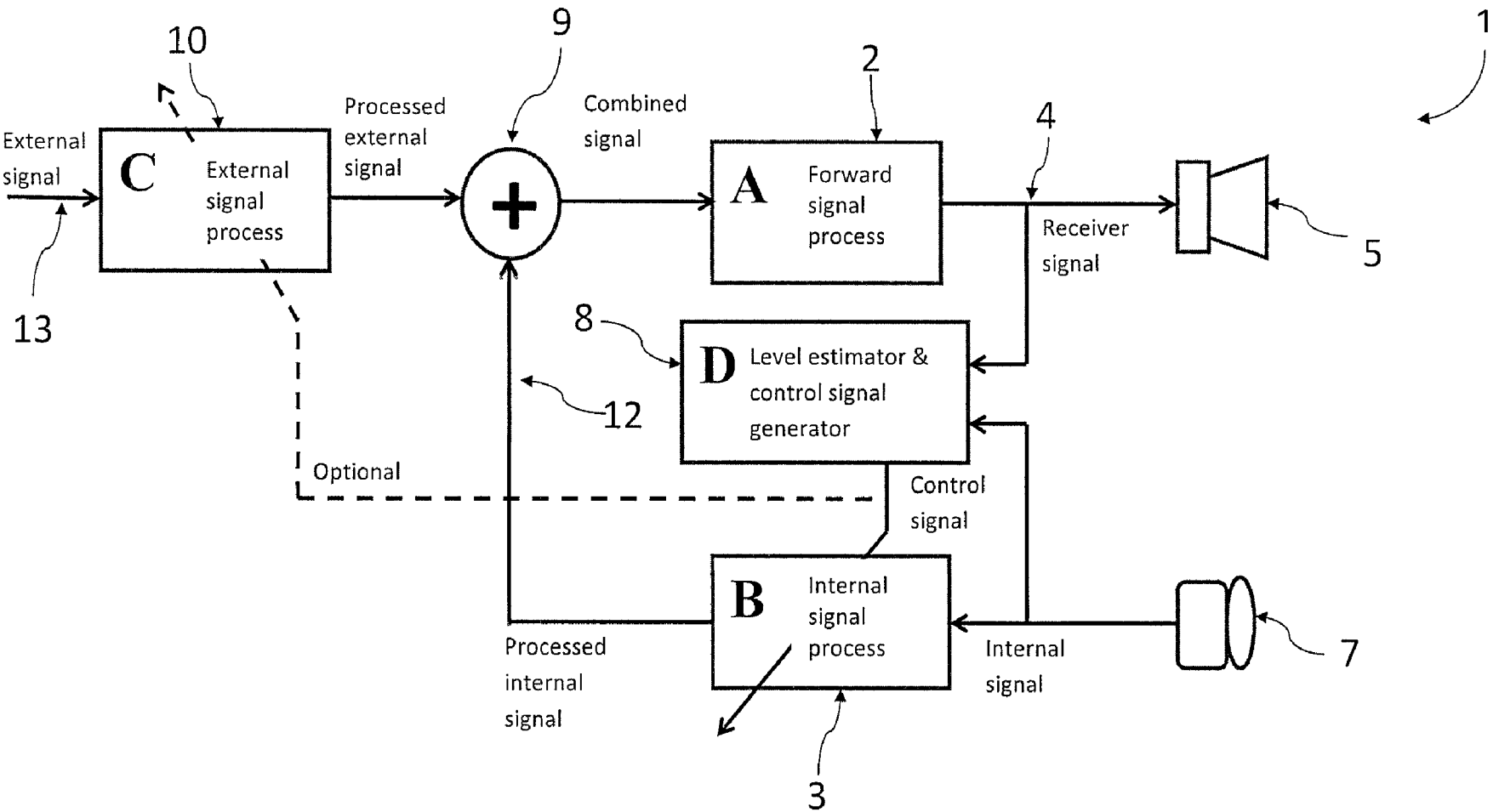
Figure 1D:
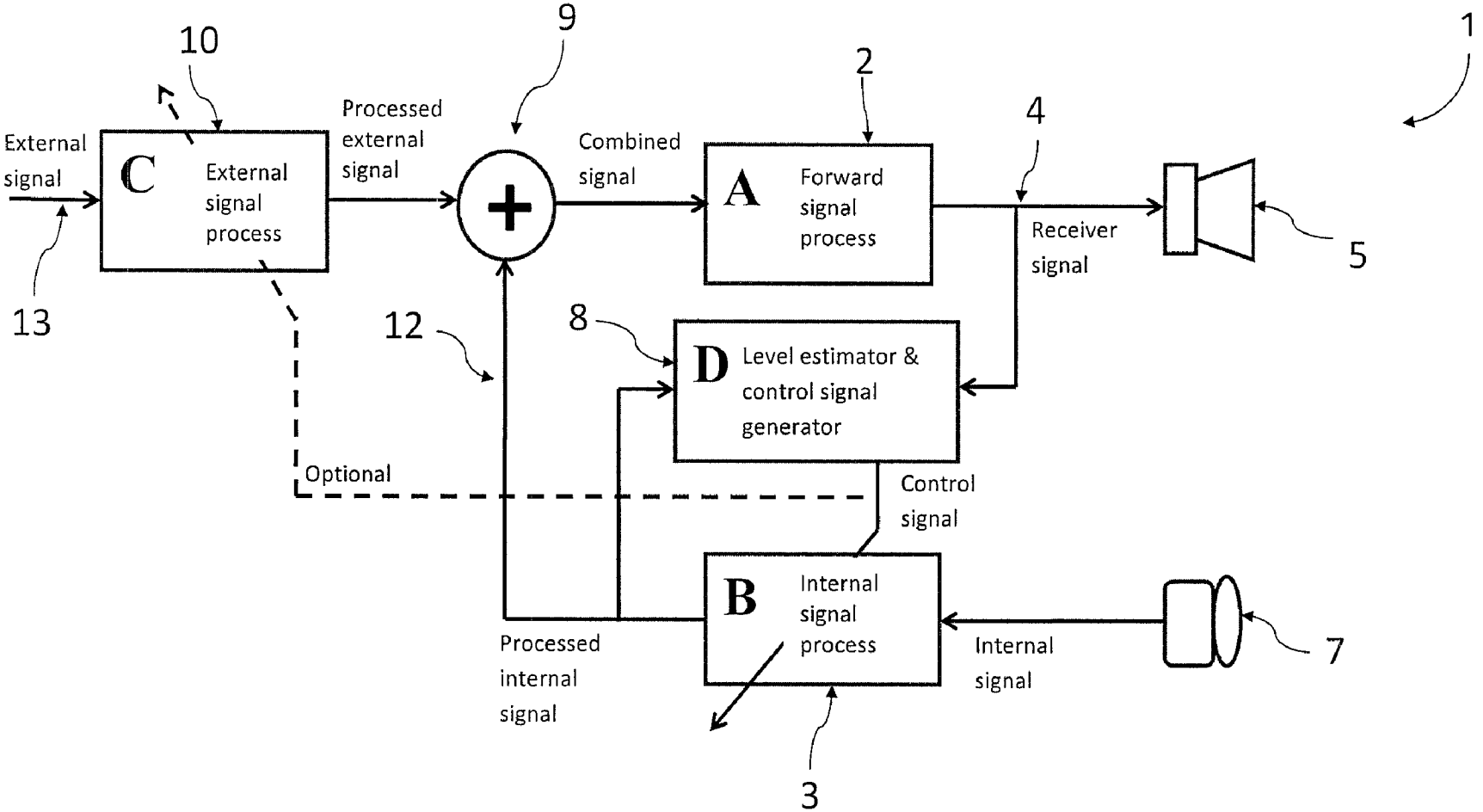
Figure 1E:
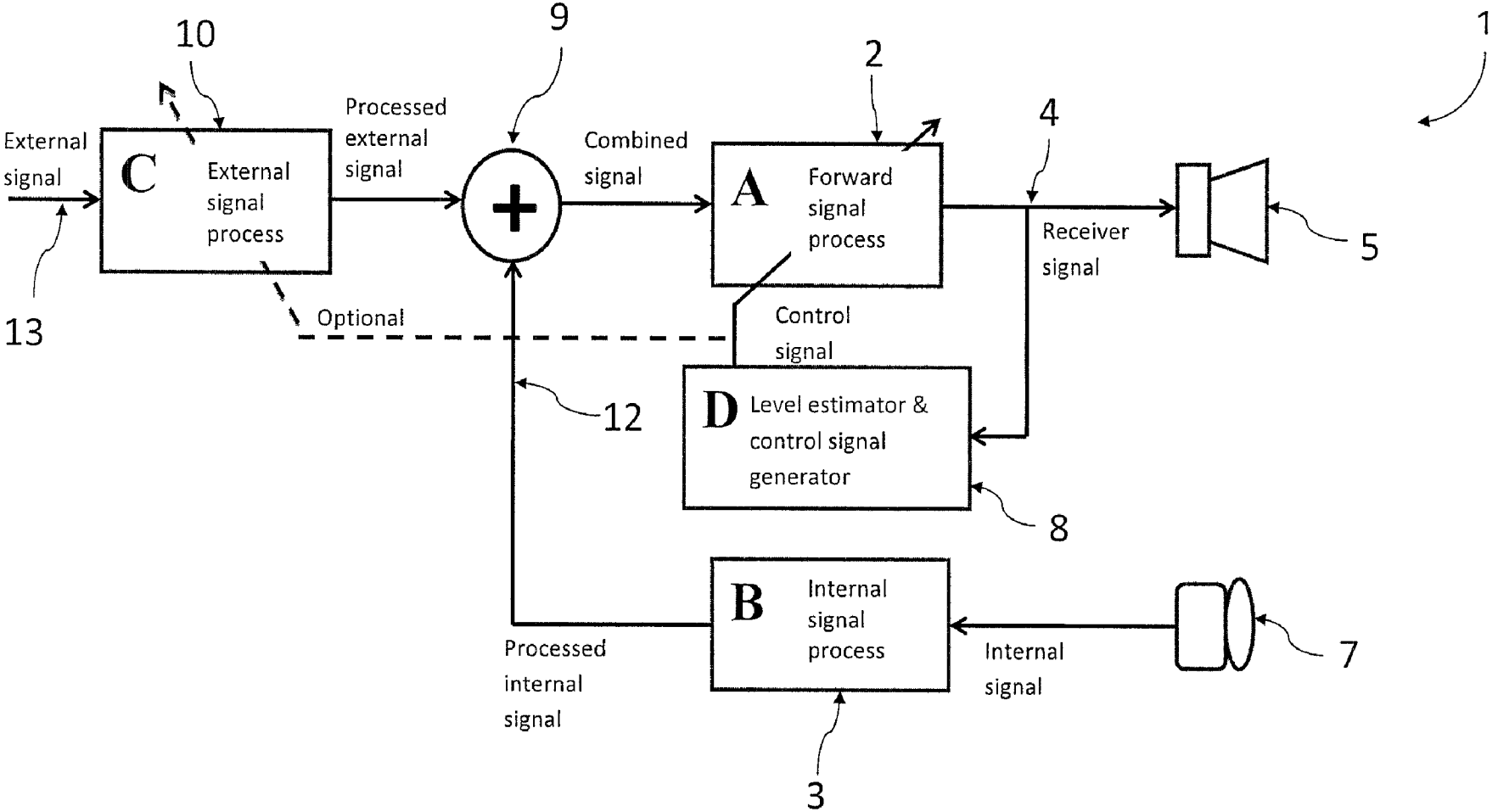
Figure 1F:
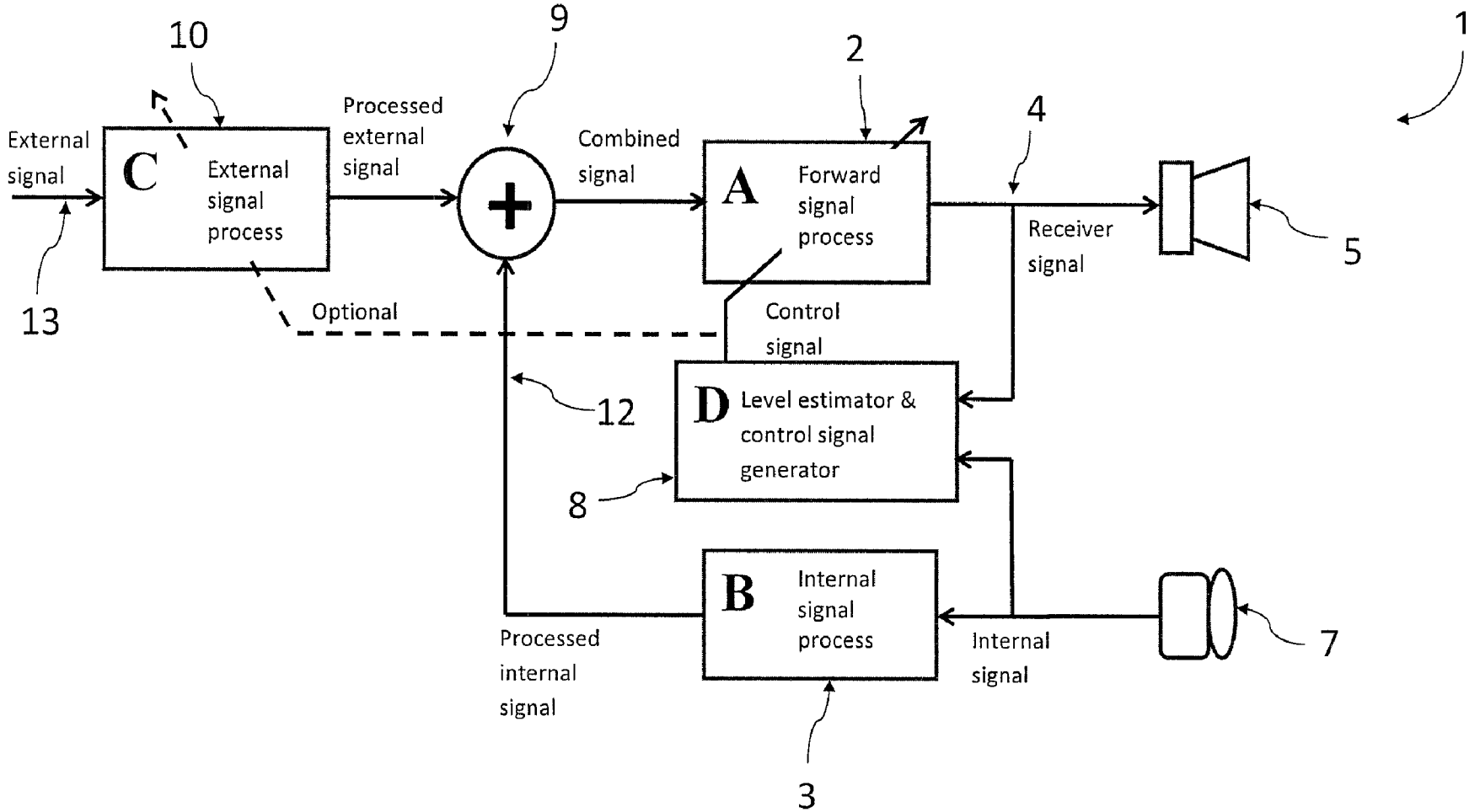
Figure 1G:
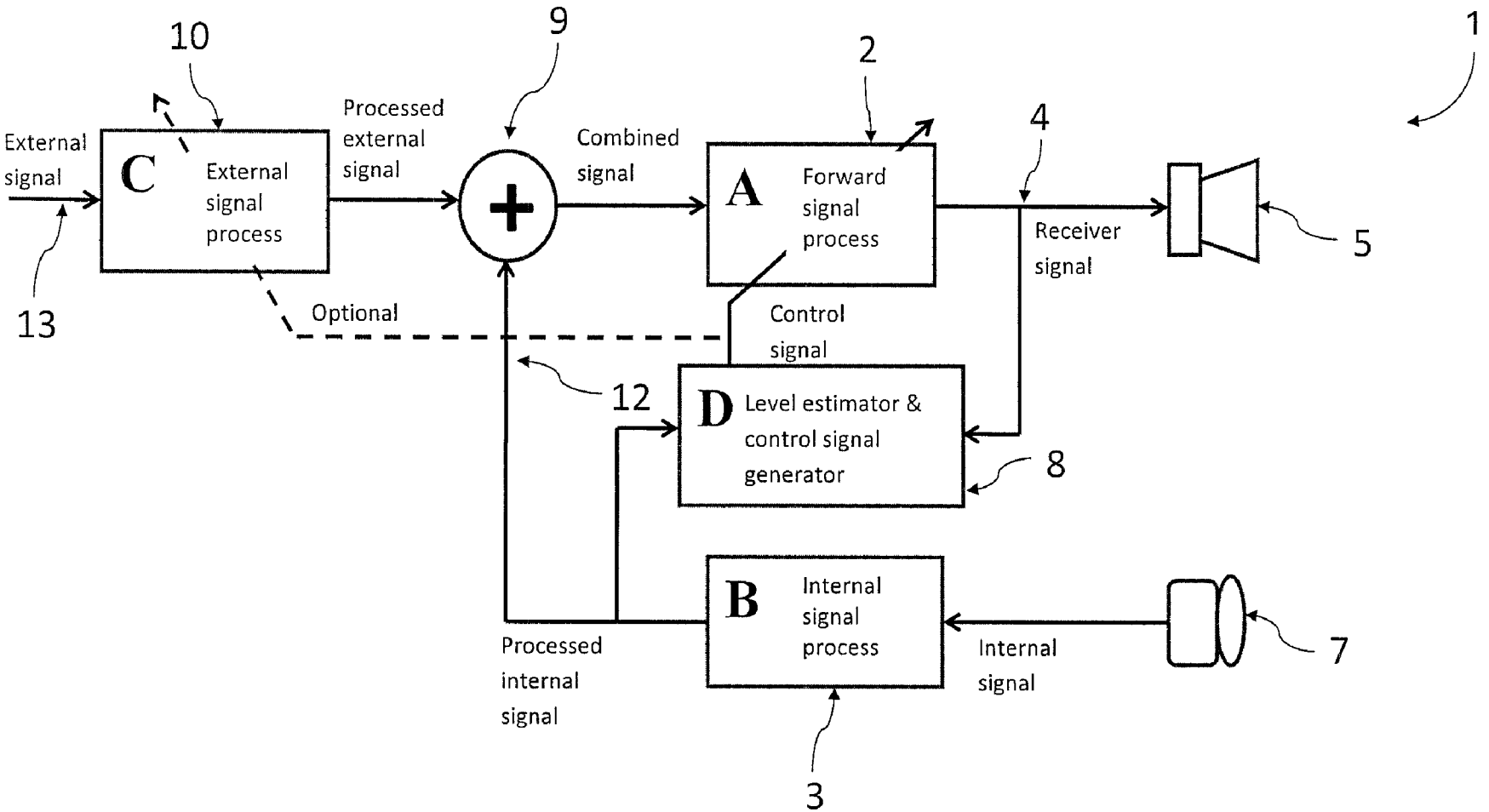

The preferred embodiment operates to reduce the level of signals generated within an electro-acoustic negative feedback loop, such as signals produced by vibration in the ear canal walls due to bone conduction of a user's voice. The reduction occurs in the low to mid audible frequencies, typically ranging from 80 Hz up to 1 kHz, where the occlusion effect is more predominant and perceptually apparent.

A negative feedback scheme is provided which combines a processed externally generated signal such as from an external microphone or a sound system with a processed internal signal such as from a microphone located within or closely coupled to the occluded or partially occluded ear. The combined signal after optional further processing is applied to a receiver located within or closely coupled to the occluded or partially occluded ear. The level of the signal to be applied to the receiver is optimally estimated either from the signal applied to the receiver or from the combined processed external and processed internal signals. Optionally this signal level can be estimated from signals at other points within the scheme. High signal levels applied to the receiver may produce a distorted output from the receiver. This distortion is reduced by applying active gain reduction in the feedback path in response to estimated high signal levels being present. Optionally low signal levels can be detected so that noise inherent in the negative feedback components such as the internal microphone can be minimised by applying active gain reduction in the feedback path. Thus, the high and the low signal level thresholds for gain reduction in the loop can depend on the dynamic operational range of the discrete components within the system. In addition, an adaptive equalisation filter is applied to the external signal to compensate for variations of the transfer response of the closed loop.

The preferred embodiment includes of a microphone to sense the sound pressure in the ear. The preferred embodiment also includes a novel design of estimating the level of the signal to be applied to the receiver and reducing the gain in the feedback path of the loop when this level is high. This mechanism effectively improves the robustness of the closed loop system by limiting excessive driving levels being applied to the receiver. A filter within the feedback path of the loop yields the necessary phase and gain around the loop to generate a phase cancelling sound in the ear without creating acoustic feedback. This negative feedback response also causes a sound pressure reduction for external signals thus affecting the response from the external processed signal to the receiver signal. As a result, an adaptive pre-compensation filter is provided. The adaptive pre-compensation filter performs adaptive equalisation to maintain a constant frequency response between the external signal and the receiver signal in response to changes in loop response.

In addition, the negative feedback response also causes a reduction in external sounds transmitted through a vent or leakage, thus minimising both effects.

Referring initially to FIG. 1, a schematic diagram 1 illustrates the occlusion reduction scheme of the preferred embodiment. This electronic circuit can be encapsulated in an earmold 100 as discussed hereinafter with reference to FIG. 11. The earmold optionally contains tubing for coupling the receiver to the ear. The earmold optionally contains tubing for coupling the internal microphone to the ear. The microphone and receiver optionally can be combined into a single unit or jointly coupled to the occluded or partially occluded ear by a common tube. Optionally these tubes can be protected from wax blockage using wax guards. The lengths of these tubes are preferably as short as possible to minimise delays around the feedback loop, but can be any length. The earmold can optionally contain an open vent to depressurise the ear thus reducing the sensation of stuffiness in the ear. Optionally, the vent can be fitted with an acoustic damper for compensating for the vent resonance that may affect the closed loop response.

The internal signal from an internal microphone 7 is proportional to the ear canal sound pressure. This internal signal is filtered in a feedback loop shown as first electronic circuit (A) 2 and second electronic circuit (B) 3 to produce the receiver signal 4 output to the receiver 5. The aim is to produce cancellation around the loop, limited to a given low to mid frequency band.

Figure 2:
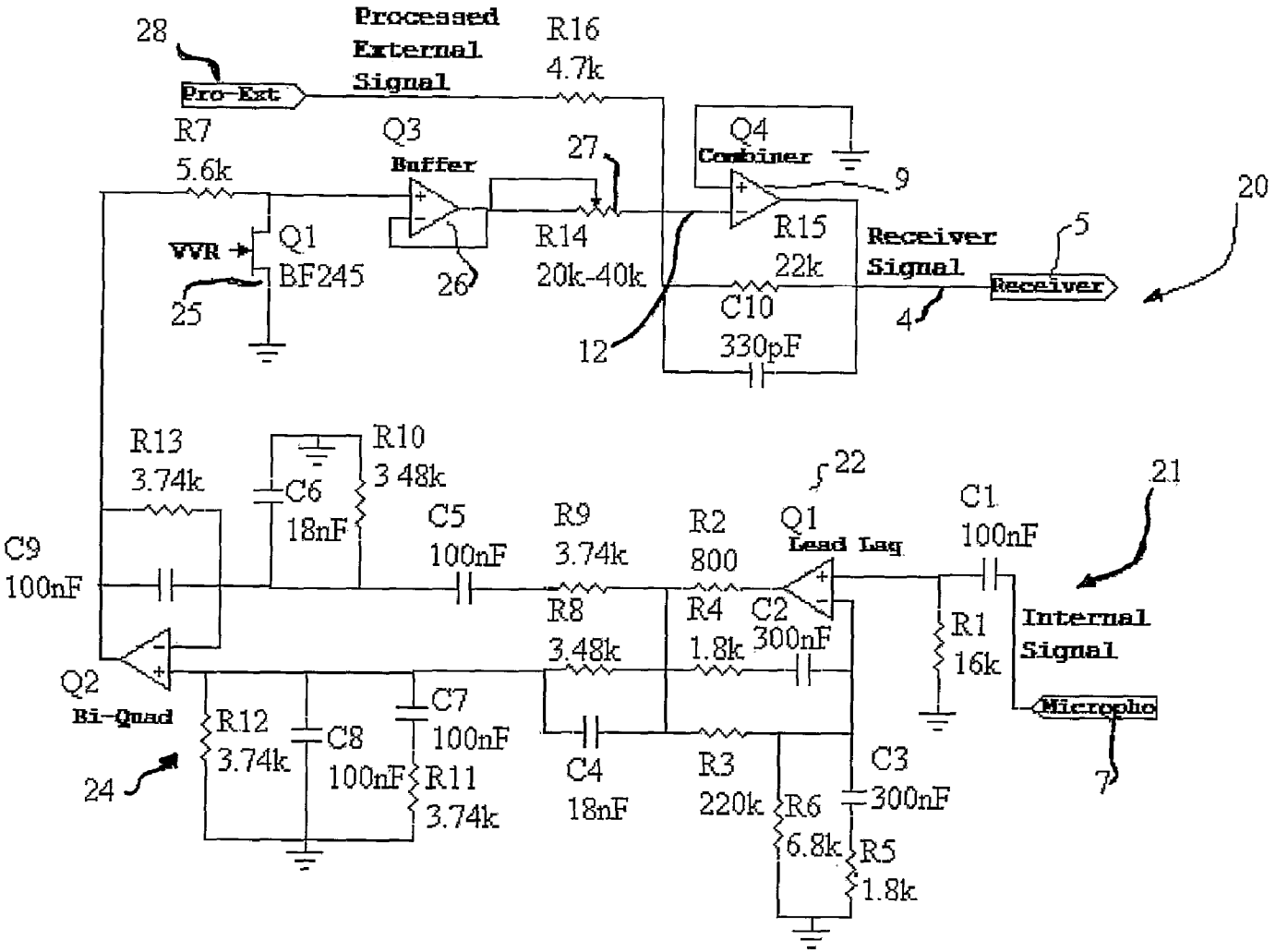
FIG. 2 is a schematic diagram of an analog electronic circuit for the electro-acoustic negative feedback loop.
Figure 3:
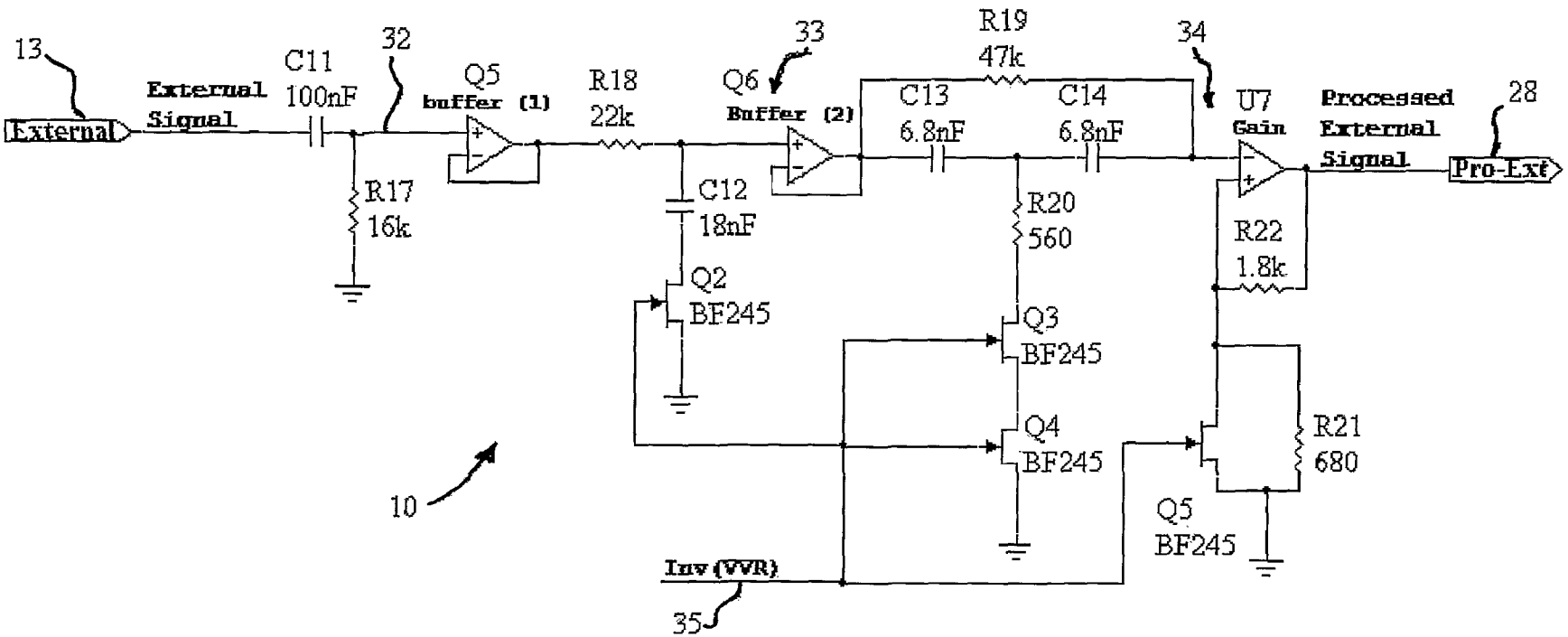
FIG. 3 is a schematic diagram of an analog adaptive pre-compensation electronic circuit.
Figure 4:
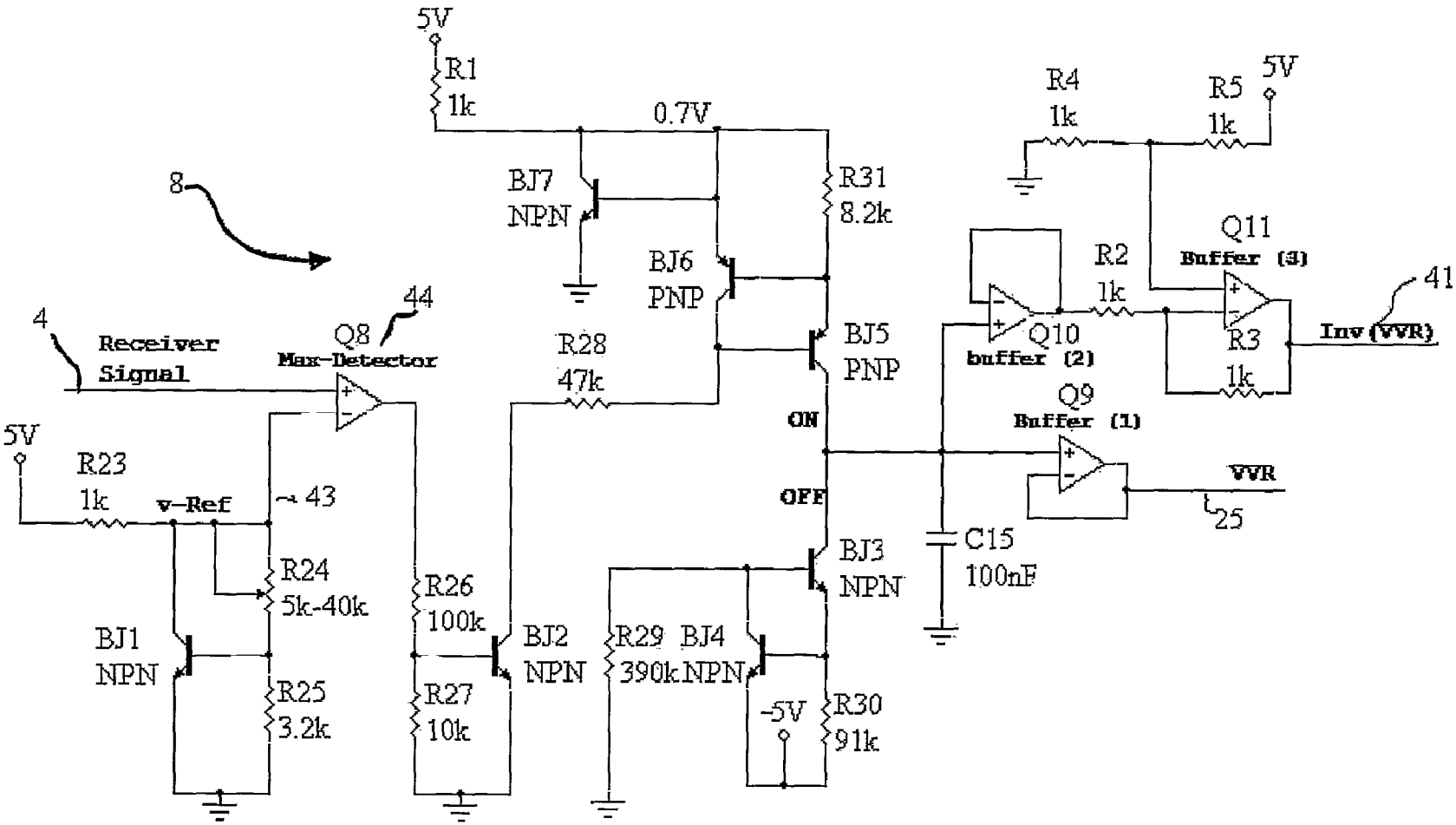
FIG. 4 is a schematic diagram of an analog level estimator and control signal generation electronic circuit.
Figure 5:
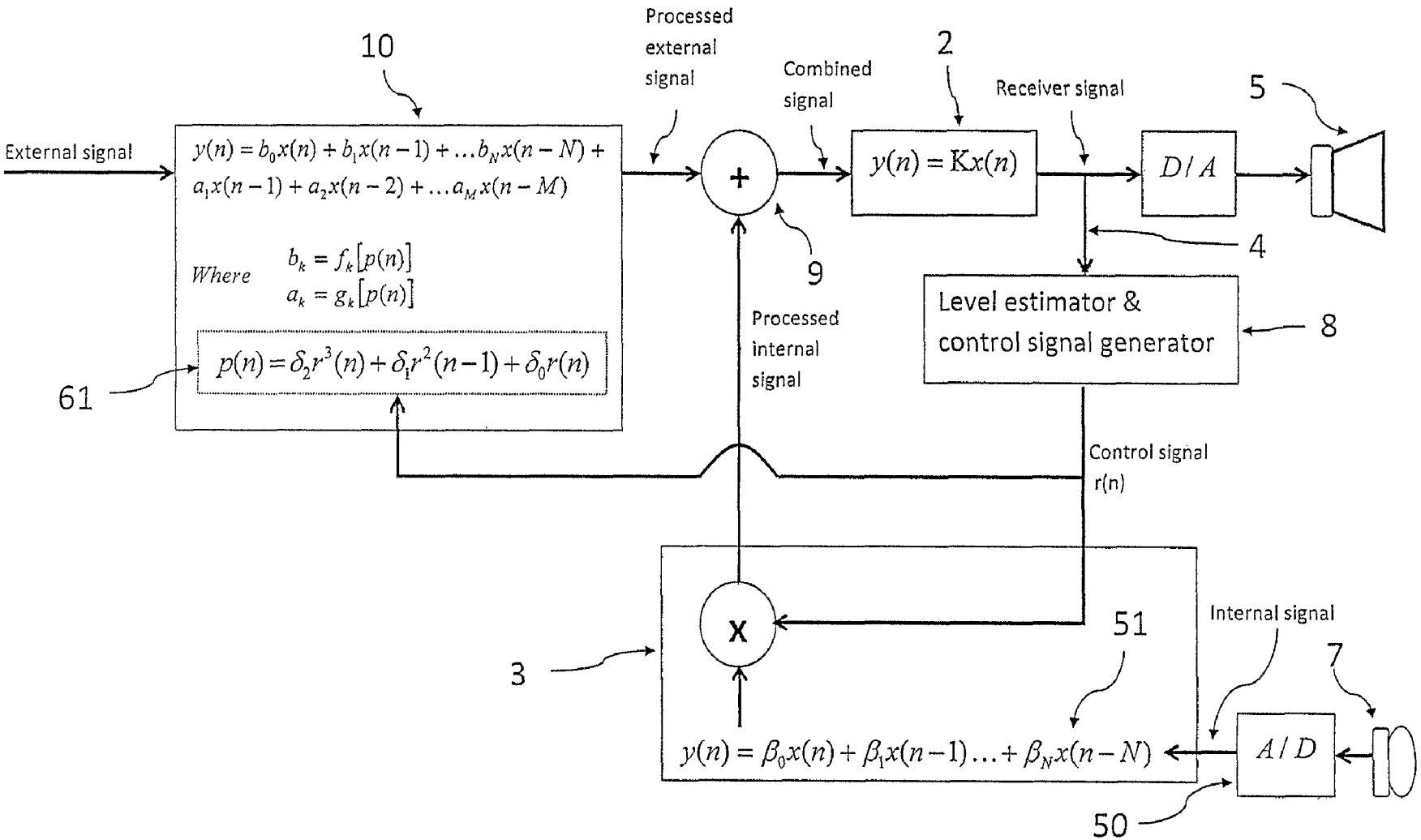
FIG. 5 is a schematic diagram of a digital implementation of the occlusion reduction scheme.
Figure 6:
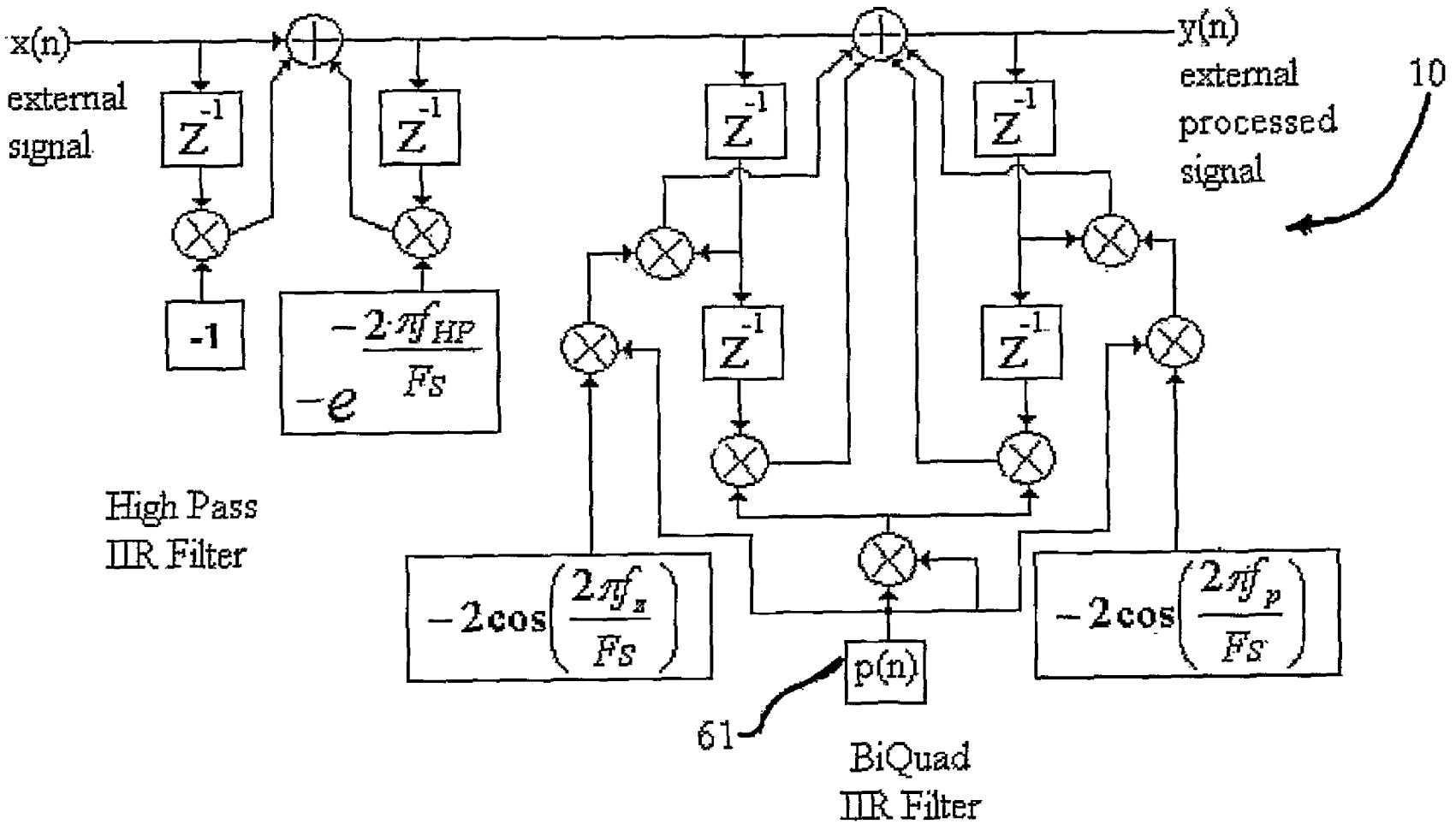
FIG. 6 is a schematic diagram of an adaptive IIR filter.
Figure 7:
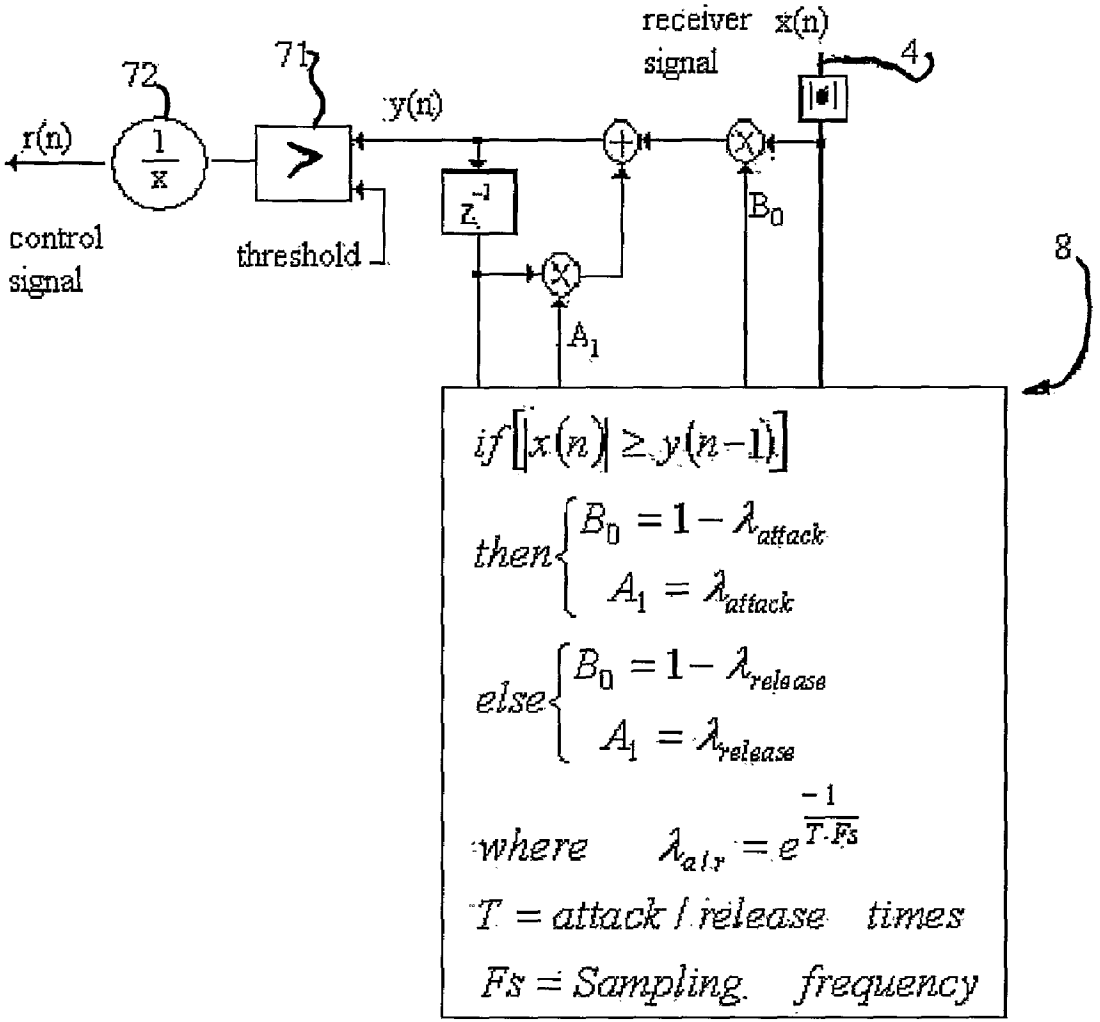
FIG. 7 is a schematic diagram of a level estimator and control signal generator.

An analog implementation of the occlusion reduction scheme is depicted in FIGS. 2-4 and a digital implementation is shown in FIGS. 5-7.

In addition, FIG. 1 shows fourth electronic circuit (D) 8 that estimates the level of the receiver signal to produce a control signal. Optionally the input to the fourth electronic circuit (D) 8 can be obtained from the output of a combiner 9 with appropriate compensation for the effects of the first electronic circuit (A) 2. The response of the negative feedback loop is controlled by the control signal. The estimated level of the receive signal 4 can be compared to a reference level which is not shown in this figure. The control signal reduces the gain in the loop as the level of the receive signal increases above the reference level. The reference level is set to a level to minimise distortion occurring within the loop.

The combined signal within the loop results from a combination 9 of processed internal signal 12 and processed external signal. The processed external signal results from a filtered external signal 13. The pre-compensation filter 10 depicted as the third electronic circuit (C) 10 in FIG. 1, equalises the magnitude of the transfer function from the external signal 13 to the receiver signal 4 so that it is approximately constant across frequency, assuming a fixed closed loop response. Optionally, the filter in the third electronic circuit (C) 10 is adaptively controlled by fourth electronic circuit (D) 8 so that the magnitude of the transfer function from the external signal 13 to the receiver signal 4 is approximately constant across frequency regardless of changes in the closed loop response.

Optionally the fourth electronic circuit (D) uses estimates of signal levels from the receiver signal or combined signal and from the internal signal or processed internal signal to produce a control signal to control the loop response. This control signal can control the loop response by directly applying gain reduction to the first electronic circuit (A) or to the second electronic circuit (B). The control signal produce from this arrangement can be used in combination with the fixed or adaptive third electronic circuit (C).

Analog Implementation

FIG. 2, depicts an analog implementation 20 of the negative feedback loop of FIG. 1. Firstly, the internal signal is applied to a high pass filter 21 and lead-lag filter 22 in order to reduce effects from jaw movements and very low frequency instability in the loop. The equations for the transfer function in relation to the corresponding discrete components are shown below:

$$H_{HP}(j\omega) = \frac{j\omega \cdot R_1 C_2}{1 + j\omega \cdot R_1 \times C_1}$$

if $R_4=R_5$, $C_2=C_3$ then the lead lag transfer function equation is shown below $$H_{Lead-Lag}(j\omega) = \frac{(R_3 + R_6) + j\omega \cdot C_2 \cdot (2R_3R_6 + R_6R_4 + R_3R_4)}{R_6 + j\omega \cdot C_2 \cdot (R_3R_6 + R_6R_4)}$$

The next filtering stage reduces the dominant transducer resonance within the loop and provides greater open loop gain at frequencies at which the occlusion effect is greatest. This is achieved by using a bi-quadratic filter 24, and placing a complex pair of zeros at the dominant transducer resonance frequency followed by a pair of real poles to provide low frequency emphasis in the open loop response.

In the arrangement of FIG. 2, if we allow $R_8=R_{10}$, $C_4=C_6$, $R_9=R_{11}$, $C_5=C_7$ an $R_{12}=R_{13}$, $C_8=C_9$, then the biquadratic transfer function equation can be computed as follows $$H_{bi-quad}(j\omega) = \frac{(j\omega)^2 C_4 R_9 C_5 + j\omega\left(C_4 + \frac{C_5 R_9}{R_8} - C_5\right) + \frac{1}{R_8}}{(j\omega)^2 C_5 R_9 C_8 + j\omega\left(\frac{C_5 R_9}{R_{12}} + C_8\right) + \frac{1}{R_{12}}}$$

To determine the pole zero placement, the biquadratic transfer function equation can be directly related to a well known second order transfer function equation.

$$K(j\omega) = \frac{(j\omega)^2 + 2\xi_z\omega_z j\omega + \omega_z^2}{(j\omega)^2 + 2\zeta_p\omega_p j\omega + \omega_p^2}$$

Where the $\omega_p$ and $\omega_z$ are the location of the pole and zero frequencies. Similarly $\xi_z$ and $\xi_p$ are the damping factors for the poles and zeros respectively. Thus, this relationship can be used to position the poles and zeros at the desired frequencies with the desired damping.

With appropriate phase compensation, amplification is added to the loop. The gain amplification is chosen in accordance to a well-known gain and phase margin criteria (e.g. Linear Control Systems Analysis and Designs, John J. D'Azzo, Constantine H. Houpis, 2nd Edition, McGraw-Hill, 1981). A loop gain of less than or equal to −3 dB is chosen at frequencies likely to produce positive feedback. The filtering arrangement of FIG. 1 shown in FIG. 2, produces a gain greater than unity, for an open loop response between 80 Hz and 1 kHz and less than unity at other frequencies, where positive feedback may occur. The frequency band ranging from 80 Hz up to 1 kHz is an appropriated choice as the occlusion effect is subjectively more apparent at these frequencies, as described in literature (e.g. Hearing Aids, Harvey Dillon, Boomerang-Press, 2001).

The bi-quadratic filter 24 is followed up by a voltage controlled variable resistance 25, referred to as VVR. This control produces up to −20 dB of gain around the loop, by controlling the voltage at the gate of the JFET. Thus, the gain across the VVR network is found by observing that the JFET is series with $R_7$ forms a voltage divider, with its gain given by:

$$Gain_{VVR} = \frac{R_{Q1}}{R_7 + R_{Q1}}$$

Where $R_{Q1}$, is the variable resistance across drain to source junction.

The VVR is followed by a buffer stage 26, that is subsequently followed by a variable resistor, $R_{14}$. 27. This latter resistor is used to fined tune the gain around the loop manually. The variable resistor 27 is followed by an amplifier and a combiner 9, combining a processed external signal 28 with the processed internal signal 12. Finally, this buffer functions as a voltage controlled voltage source to the receiver, optionally a class D amplifier may be used.

Referring now to FIG. 3, there is illustrated the precompensation circuit 10 of FIG. 1 in more detail. The circuit may be used to pre-compensate an external signal 13 to produce a processed external signal 28. The external signal is pre-compensated with a fixed high pass filter 32, a variable notch filter 33, and an adjustable gain control 34. Note that the notch and the gain are also controlled with voltage variable resistances, using JFET transistors.

If $C_{13}$=$C_{14}$, then the transfer function equation for the notch filter, positioned between U6 and U7 is shown below $$H_{Notch}(j\omega) = \frac{1 + j\omega(2R_xC_{13}) + (R_xR_{19}C_{13}^2)\cdot(j\omega)^2}{1 + j\omega(R_{19} + 2R_x)C_{13} + (R_xR_{19}C_{13}^2)\cdot(j\omega)^2}$$

Where $R_x$=$R_{20}$+$R_{Q3}$+$R_{Q4}$ and $R_{Q3}$+$R_4$ is the combined resistance across drain to source junction of the two JFET transistors. Also note that the amplification at U7 is controlled by the source to drain resistance at Q5, and the low pass filter between U5 and U6 is essentially switched on and off by Q2.

The voltage variable resistances shown in FIG. 2 and 3 are driven by the circuit 40 shown in FIG. 4. This circuit functions as a signal level estimator and threshold detector and produces a control voltage 41. In this circuit the receiver signal 4 is compared to a reference voltage 43, shown as v-Ref in the figure, at the negative input of U8 (44). If this voltage does not exceed the reference level, the current source, made up by BJ3 and BJ4 transistor pair pulls down the voltage across the RC tank towards the negative supply voltage, with a time constant equal to the release time. Note that the voltage across the RC tank feeds directly into the gate of the JFET control transistor in FIG. 2 from U9 buffer (1), resulting in a VVR signal 25. Similarly from U10 and U11 buffer (2) and buffer (3), results is an inverted VVR signal 35, that is directly applied to the gates of all the JFET transistors shown in FIG. 3. As the voltage exceeds the threshold reference level, the current source, shown as BJ6 and BJ5 transistor pair, charges the RC tank, towards the base voltage at BJ6, with a time constant set by the attack time. The attack and release time constants can be approximated by finding the appropriate ratio between resistors $R_{31}$ and $R_{30}$.

The voltage across the capacitor $C_{15}$ ranges from a voltage at the based of BJ7, say 0.7V or fully charged to the voltage at the collector of BJ3, say −2.8V or fully discharged, then the change in voltage ΔV≈3.5V, from which the current needed to produce the discharging rate can be evaluated as follows:

$$\text{Discharging } I = C_{15} \times \frac{\Delta V}{\text{Release_Time}} = 7uA$$

$$\text{thus effectively } I_{charging} \approx 11 \times I_{discharging}$$

$$\text{Then } R_{31} = \frac{0.7}{77u} \approx 8.2 \text{ k}$$

$$R_{30} = 11 \times R_{31} \approx 91 \text{ k}$$

Digital Implementation

A digital implementation of the arrangement of FIG. 1 typically requires the signal within the loop to be oversampled to reduce the delay introduced into the loop by sampling. The signal processing performed by electronic circuits A, B, C and D and the combiner 9 may be performed digitally. The digital processing optionally is performed by a digital signal processor which is instructed to perform the signal processing. Various techniques are available to those skilled in the art to perform these processes. Examples of these are performing the filtering operations using FIR or IIR filters or modifying the signals in the frequency domain using the short-time Fourier transform techniques. One implementation of the scheme described for FIG. 1 is shown in FIGS. 5-7.

In FIG. 5, after A/D conversion 50, the internal signal is filtered with an IIR filter 51 in order to provide the required gain and phase compensation, with the same criteria applied in the description of FIG. 2.

In this digital implementation the level of the receiver signal 4 is directly estimated and the control signal r(n) is produced by the level estimator and control signal generator 8 which is shown in greater detailed in FIG. 7. Referring now to FIG. 7, the receive signal level is estimated with a digital $1^{st}$ order switchable time-constant envelope detector. The envelope signal is compared 71 to a threshold value and the maximum of either the ratio of its exceedance of this threshold or unity is produced. This maximum is inverted to produce the control signal. As the level of the envelope signal exceeds the threshold, the control signal shown as r(n) decreases at a rate determined by the attack time constant $\lambda_{attack}$. As the envelope signal decreases in level, the control signal increases at a rate determined by the release time constant $\lambda_{release}$. Alternative signal level compression strategies employing different envelope detector designs well known to those skilled in the art may be used.

The internal signal, after being filtered by the IIR filter 51, is scaled by the control signal r(n) to produce the processed internal signal. The processed external signal is added to the processed internal signal by the combiner 9 to produce the combined signal. The combined signal is scaled 2 to produce the receiver signal 4 which after D/A conversion is applied to the receiver 5.

As in the analog description, the negative feedback loop requires pre-compensation so that the gain response measured from the external signal to the receiver signal is not altered by the closed loop response. In FIG. 5, the pre-compensation filter 10 is realised as a cascaded IIR filter, with a structural realisation shown in FIG. 6. The first filter stage shown in FIG. 6 is a high pass filter, comprising of a zero at 0 Hz and a pole at $f_{HP}$, the coefficient being a function of the sampling rate, Fs. The second stage of the filter shown in FIG. 6 is adaptive, the locations of poles $f_p$ and zeros $f_z$ of the digital filter are varied in accordance with the output of a mapping function p(n) 61. Alternatively the damping factors for the poles and zeros can be controlled by two independent mapping functions derived from the control signal r(n). FIG. 5 shows p(n) as a single output from a polynomial mapping function with input r(n). The polynomial's coefficients are found using an autoregressive analysis of the required compensating response as a function of the control signal r(n).

Any combination of analog and digital electronic circuits is possible in addition to the all analogue and the all digital implementations described with the appropriate conversions between analogue and digital formats. In particular, electronic circuits B, C and D may be implemented digitally with the combiner and electronic circuit A implemented in analog circuitry. Furthermore, the processed internal and processed external signals may be combined while both in a 1-bit format and applied directly to the receiver without electronic circuit A performing any function or with it simply providing the 1-bit drive current for the receiver.

Figure 8:
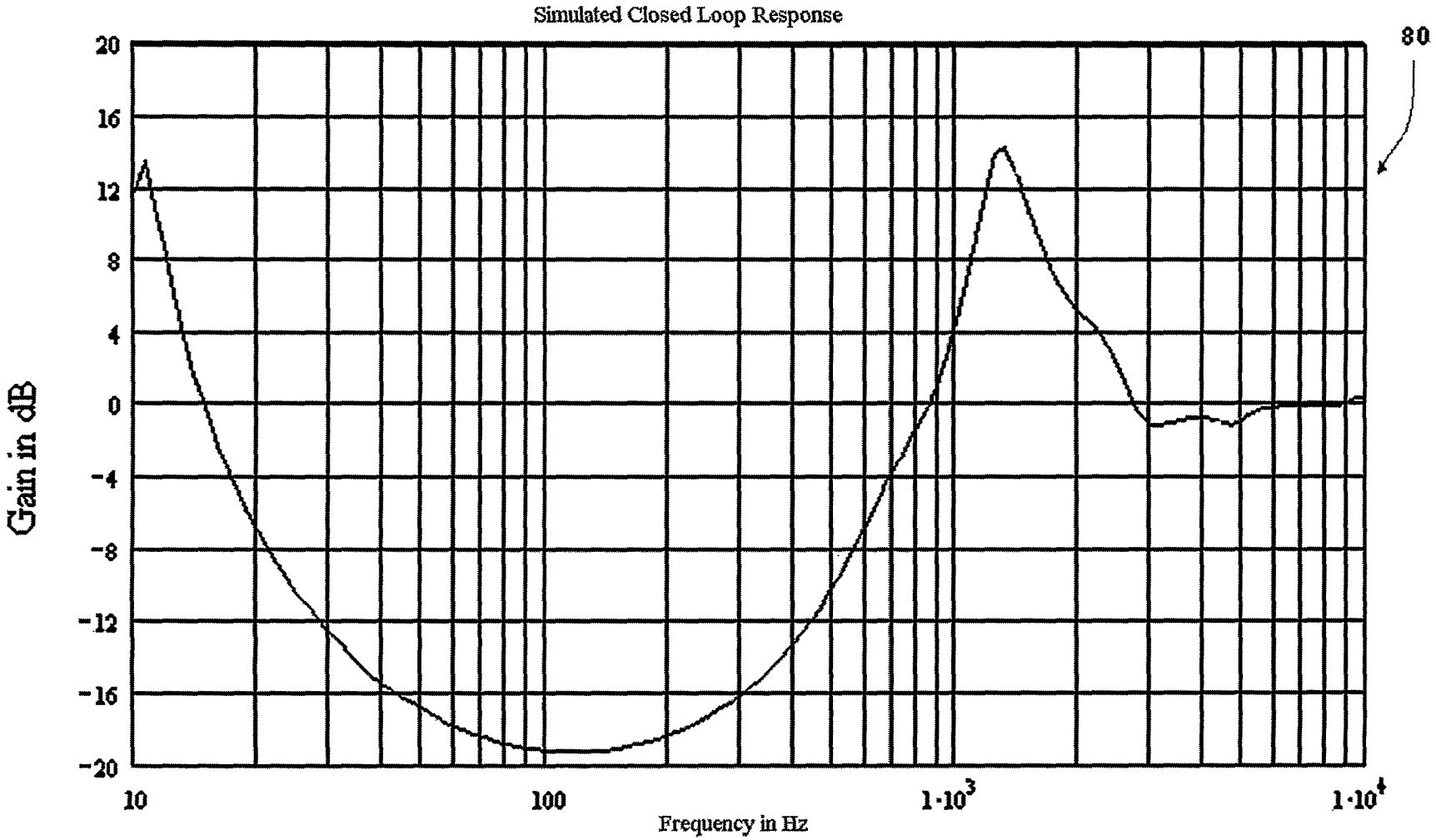
FIG. 8 is a graph of the simulated closed loop response in a Zwislocki coupler.
Figure 9:
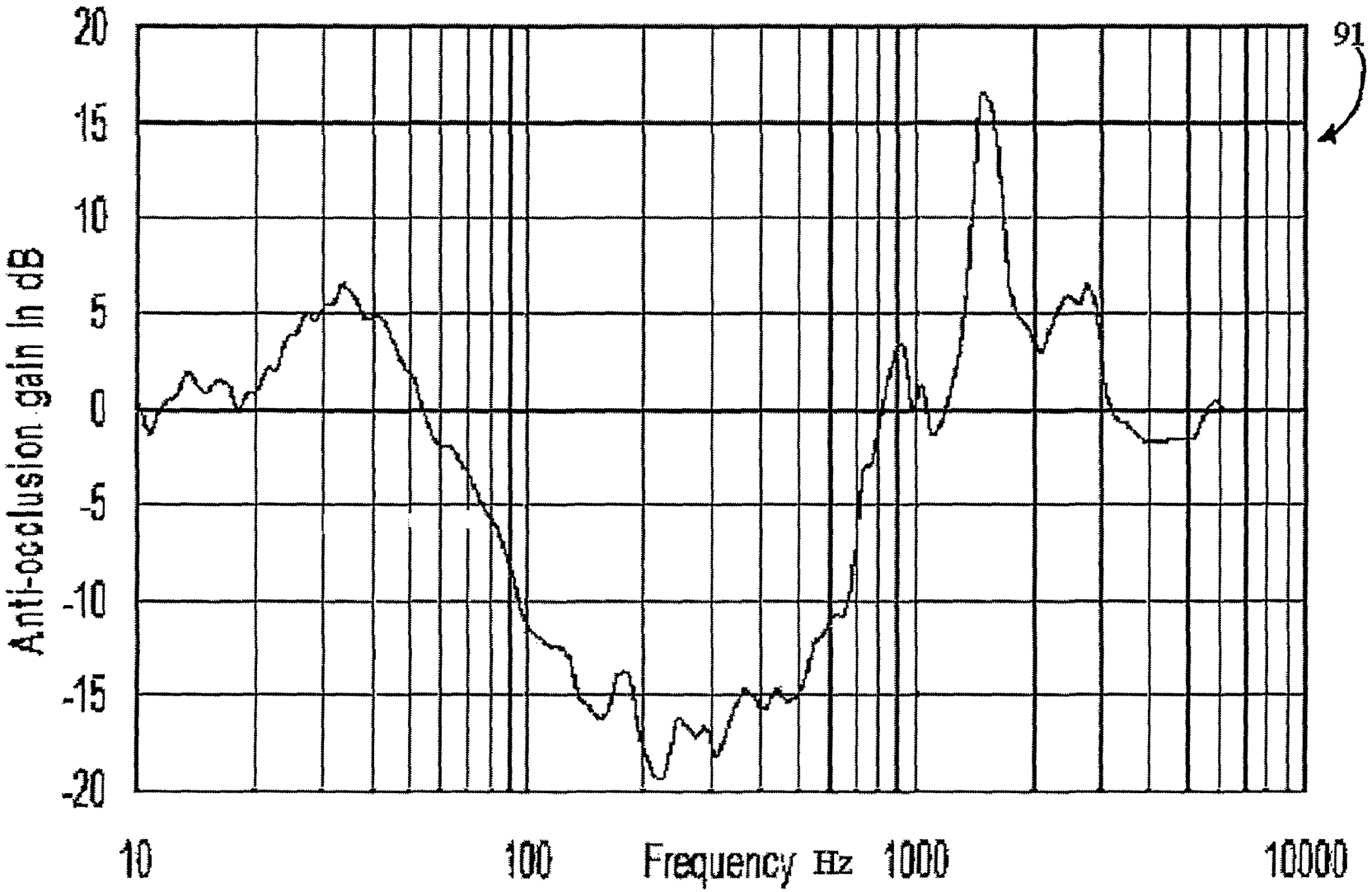
FIG. 9 is a graph of the measured response of the effective gain reduction inside a real ear.

Referring now to FIG. 8 the simulated closed loop response in a Zwislocki coupler is shown. The scheme yields approximately 16 dB of occlusion reduction at 300 Hz, and 18 dB at 100 Hz. The occlusion reduction response is a measure of the level difference between the sound level in the coupler with the occlusion reduction system active and the sound level in the coupler without any occlusion reduction. Referring to FIG. 9 occlusion reduction in a real ear is shown. This was calculated by taking the linear average of the energy in 1/12 octave bands recorded using an in-the-ear-canal microphone while a subject talked for 2 minutes. This signal was recorded while the feedback loop gain is maximum, and then again while the loop was open.

Figure 10:
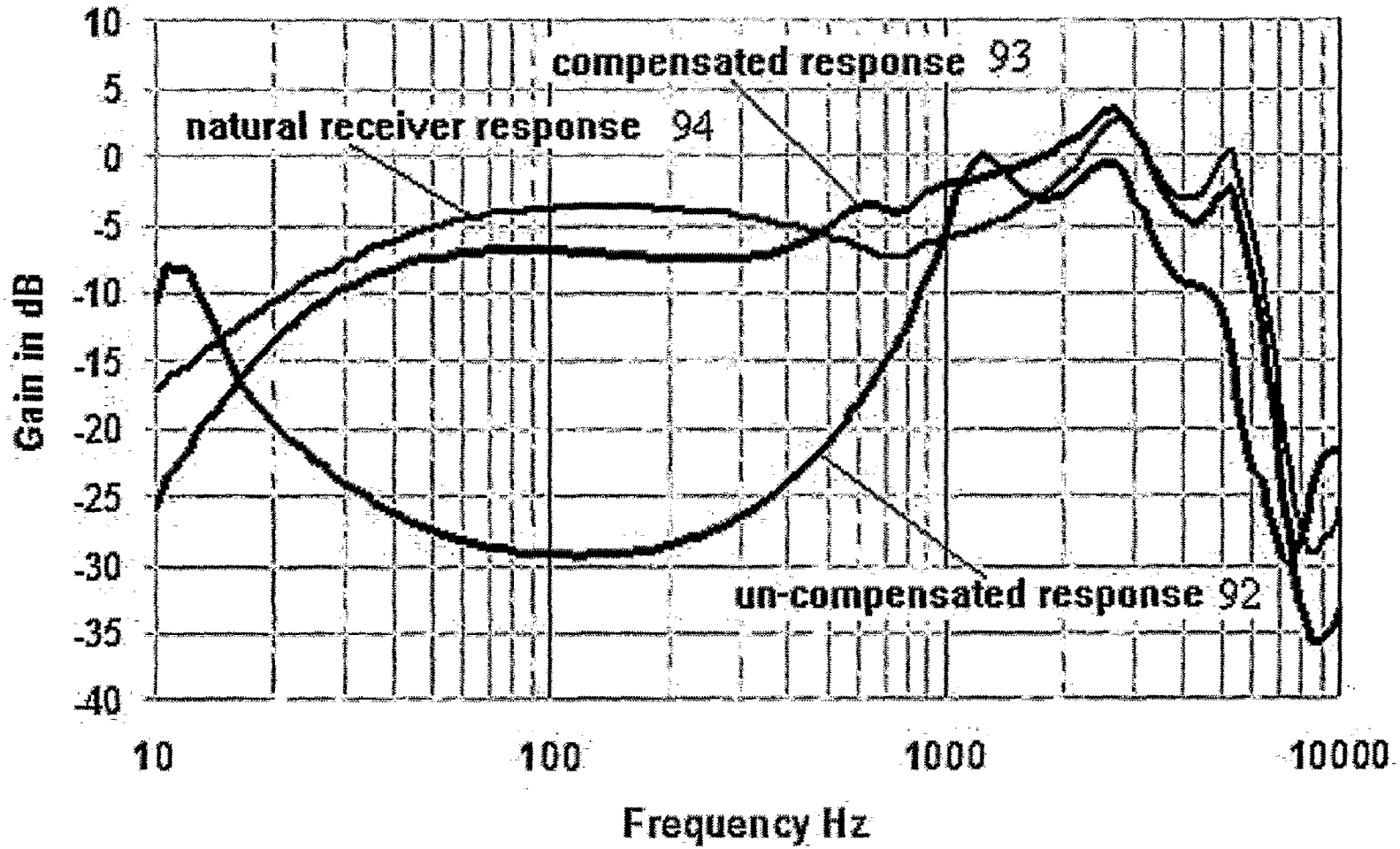
FIG. 10 is a graph of the measured responses from an external signal to a Zwislocki coupler microphone.

Referring now to FIG. 10, three responses measured in a Zwislocki coupler are shown. These are the transfer functions from an external signal to the coupler microphone for the compensated 93 and un-compensated responses 92. Also shown is the natural receiver response 94 employing a voltage controlled voltage source to the receiver. Note that the compensated response is not adversely affected by the occlusion reduction scheme compared to that of the natural receiver response 94. Also similar responses are derived for minimally open vented cavities with the appropriate changes to the mappings, filtering and gain equalisation in electronic circuits A, B, and C.

Figure 11:
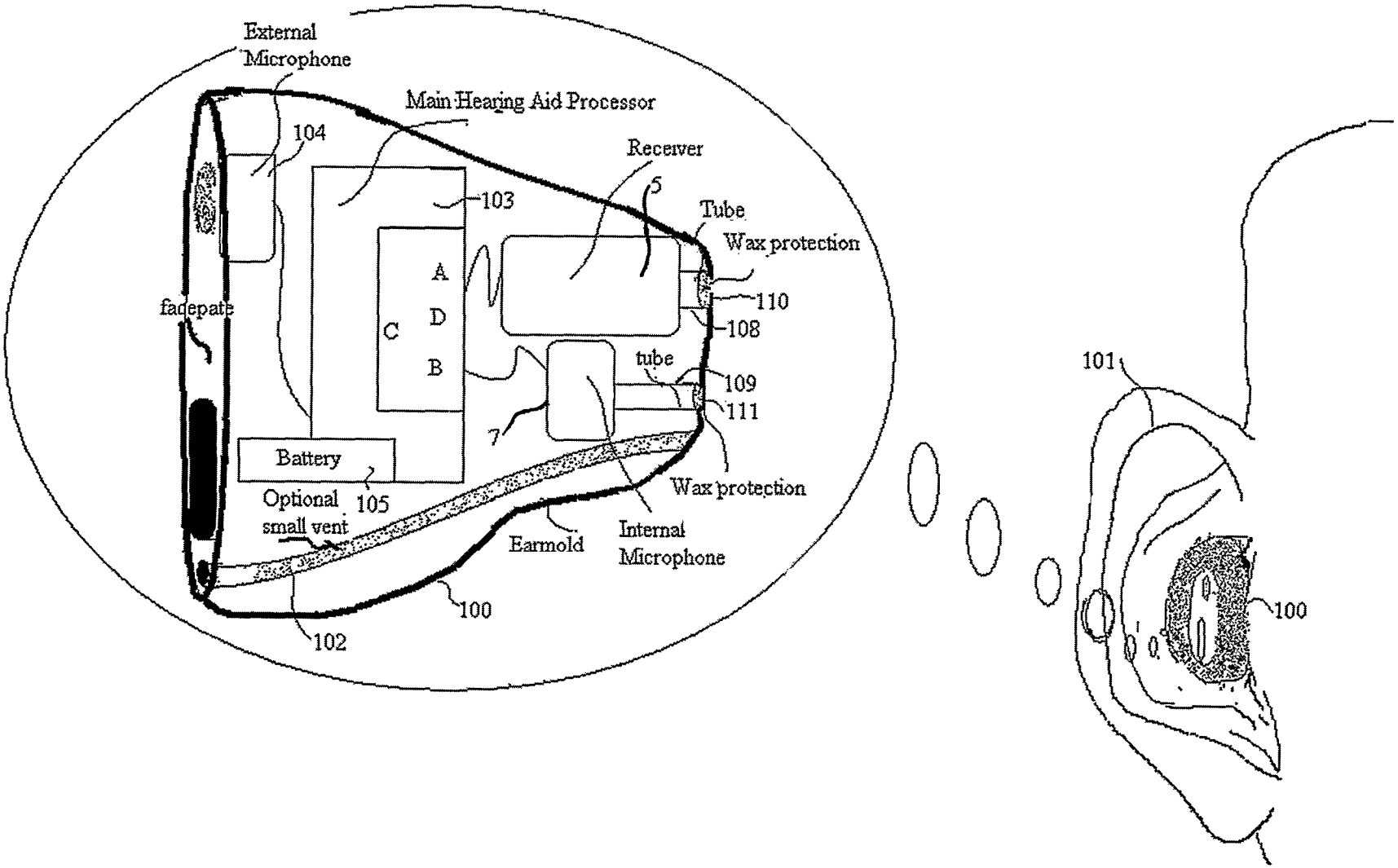
FIG. 11 is an illustration of the occlusion reduction scheme implemented as an in-the-canal hearing aid device.

Referring now to FIG. 11, there is shown one form of actual implementation of the present invention as an in-the-canal hearing aid device 100 placed in a user's ear 101 that substantially eliminates the discomfort associated with the occlusion effect. The device 100 includes a sealed or optionally vented 102 earmold that occludes or partially occludes the ear canal. The earmold encapsulates a hearing aid electronic circuit comprising of: a hearing aid processor 103 directly connected to an external microphone 104 and powered by small battery 105. The hearing aid processor includes occlusion reduction electronic circuits A, B, C, D and the combiner. A separate receiver 5 and an internal microphone 7 are also interconnected. These transducer elements are acoustically coupled to the inside of the ear canal with short tubes 108, 109; and protected from ear wax with wax-guarding devices 110, 111.

The forgoing describes preferred embodiments of the present invention. Modifications, obvious to those skilled in the art, can be made thereto without departing from the scope of the invention.

The invention claimed is:

1. An electro-acoustic system including:

an electro-acoustic circuit including a negative-feedback loop, the negative feedback loop comprising of:

a microphone for generating an internal signal from an acoustical signal located within or closely coupled to an occluded or partially occluded ear;

a second electronic circuit (B) for modifying the internal signal to produce a processed internal signal;

a combiner for combining the processed internal signal with a processed external signal to produce a combined signal;

a first electronic circuit (A) for modifying the combined signal to produce a receiver signal; and a receiver for generating an acoustical signal from the receiver signal at a location within or closely coupled to the occluded or partially occluded ear;

the electro-acoustic circuit further comprising of:

a third electronic circuit (C) for modifying an external signal to produce the processed external signal; and a fourth electronic circuit (D) for estimating the level of the receiver signal either directly from the receiver signal or from the combined signal and producing a control signal from this estimate;

wherein the processing performed by the second electronic circuit (B) is controlled by the control signal.

2. A system as claimed in claim 1 wherein the negative-feedback loop includes filtering that alters the open loop response so that the real component of the response is large and negative at frequencies where the occlusion effect is most apparent.

3. A system as claimed in claim 1 wherein the third electronic circuit (C) includes filtering that provides compensation for the closed response of the negative-feedback loop.

4. A system as claimed in claim 3 wherein the filtering provided by the third electronic circuit (C) is adaptive and controlled by the control signal.

5. A system as claimed in claim 4 wherein the fourth electronic circuit (D) estimates the level of the internal signal or the level of the processed internal signal and uses this estimate with the estimate of the receiver signal to produce a control signal.

6. A system as claimed in claim 4 or claim 5 wherein the ear is occluded or partially occluded by an earmold.

7. A system as claimed in claim 6 wherein the earmold contains a vent.

8. A system as claimed in claim 7 wherein the vent contains an acoustic damper.

9. A system as claimed in claim 4 or claim 5 wherein at least one of the electronic circuits is digital and uses a sampling rate at least four times the bandwidth of the signal.

10. An electro-acoustic system including:

an electro-acoustic circuit including a negative-feedback loop, the negative feedback loop comprising of:

a microphone for generating an internal signal from an acoustical signal located within or closely coupled to an occluded or partially occluded ear;

a second electronic circuit (B) for modifying the internal signal to produce a processed internal signal;

a combiner for combining the processed internal signal with a processed external signal to produce a combined signal;

a first electronic circuit (A) for modifying the combined signal to produce a receiver signal; and a receiver for generating an acoustical signal from the receiver signal at a location within or closely coupled to the occluded or partially occluded ear;

the electro-acoustic circuit further comprising of:

a third electronic circuit (C) for modifying an external signal to produce the processed external signal; and a fourth electronic circuit (D) for estimating the level of the receiver signal and producing a control signal from this estimate;

wherein the control signal controls the processing performed by the second electronic circuit (B) and controls the processing performed by the third electronic circuit (C).

11. A method of providing a negative feedback loop for an electro-acoustic system, the method including the steps of:

(a) generating an internal signal representing an acoustical signal located within or closely coupled to an occluded or partially occluded ear;

(b) modifying the internal signal to produce a processed internal signal;

(c) combining the processed internal signal with a processed external signal to produce a combined signal;

(d) modifying the combined signal to produce a receiver signal;

(e) generating an acoustical signal from the receiver signal at a location within or closely coupled to the occluded or partially occluded ear;

(f) modifying an external signal to produce the processed external signal; and (g) estimating the level of the receiver signal either directly from the receiver signal or from the combined signal and producing a control signal from this estimate;

wherein of modification in step (b) is controlled by the control signal.

12. A method as claimed in claim 11 wherein the control signal is utilised to control the modification occurring in step (f).

13. An electro-acoustic system including:

an electro-acoustic circuit including a negative-feedback loop, the negative feedback loop comprising of:

a microphone for generating an internal signal from an acoustical signal located within or closely coupled to an occluded or partially occluded ear;

a second electronic circuit (B) for modifying the internal signal to produce a processed internal signal;

a combiner for combining the processed internal signal with a processed external signal to produce a combined signal;

a first electronic circuit (A) for modifying the combined signal to produce a receiver signal; and a receiver for generating an acoustical signal from the receiver signal at a location within or closely coupled to the occluded or partially occluded ear;

the electro-acoustic circuit further comprising of:

a third electronic circuit (C) for modifying an external signal to produce the processed external signal; and a fourth electronic circuit (D) for estimating the level of the receiver signal and producing a control signal from this estimate;

wherein the control signal controls the processing performed by first electronic circuit (A) and controls the processing performed by the third electronic circuit (C).

14. A system as claimed in claim 13 wherein the negative-feedback loop includes filtering that alters the open loop response so that the real component of the response is large and negative at frequencies where the occlusion effect is most apparent.

15. A system as claimed in claim 13 wherein the third electronic circuit (C) includes filtering that provides compensation for the closed response of the negative-feedback loop.

16. A system as claimed in claim 15 wherein the filtering provided by the third electronic circuit (C) is adaptive and controlled by the control signal.

17. A system as claimed in claim 16 wherein the fourth electronic circuit (D) estimates the level of the internal signal or the level of the processed internal signal and uses this estimate with the estimate of the receiver signal to produce a control signal.

18. A system as claimed in claim 16 or claim 17 wherein the ear is occluded or partially occluded by an earmold.

19. A system as claimed in claim 18 wherein the earmold contains a vent.

20. A system as claimed in claim 19 wherein the vent contains an acoustic damper.

21. A system as claimed in claim 16 or claim 17 wherein at least one of the electronic circuits is digital and uses a sampling rate at least four times that of the bandwidth of the signal.

* * * * *